US005421853A

United States Patent [19]

Chen et al.

[11] Patent Number: 5,421,853

[45] Date of Patent: Jun. 6, 1995

[54] HIGH PERFORMANCE BINDER/MOLDER COMPOUNDS FOR MAKING PRECISION METAL PART BY POWDER INJECTION MOLDING

[75] Inventors: Wen-Hsin Chen, Taoyuan City; Minh-Jhy Jiang, Hsinchu; Chao-Shiun Lin, Chupei City; Kuo-Yao Weng, Taoyuan City; Ming-Shyong Lai, Tainan Hsien; Jiann-Tsair Jeng, Hsinchu, all of Taiwan, Prov. of China

[73] Assignee: Industrial Technology Research Institute, Hsinchu, Taiwan, Prov. of China

[21] Appl. No.: 288,367

[22] Filed: Aug. 9, 1994

[51] Int. Cl.[6] ..... C22B 1/244

[52] U.S. Cl. ..... 75/252; 75/321; 75/767; 75/772

[58] Field of Search ..... 75/252, 767, 772, 321

[56] References Cited

U.S. PATENT DOCUMENTS

| | | | |
|---|---|---|---|
| 3,585,025 | 6/1971 | Obst | 75/321 |
| 3,644,113 | 2/1972 | Lang | 75/772 |
| 3,898,076 | 8/1975 | Ranke | 75/772 |
| 4,767,449 | 8/1988 | Rosen | 75/767 |
| 5,102,455 | 4/1992 | Allen | 75/772 |
| 5,112,391 | 5/1992 | Owen | 75/772 |

*Primary Examiner*—Peter D. Rosenberg
*Attorney, Agent, or Firm*—W. Wayne Liauh

[57] ABSTRACT

A binder composition for use in making metal parts via a metal powder injection molding process containing the following components: (a) a first polymer with a relatively low solubility parameter such as polyethylene and polypropylene; (b) a second polymer with a relatively high solubility parameter such as polystyrene and poly(methyl methacrylate); and (c) a block copolymer containing blocks of the first and second, or other structurally similar, constituting monomeric units. Examples of the block copolymers include ethylene/styrene copolymer, propylene/styrene copolymer, and isoprene/styrene copolymer, etc. The binder composition is dispersed in an appropriate dispersant, such as an oil or wax, then blended with a metal powder to form a metal powder injection composition. The metal powder injection composition forms a green compact with a predetermined shape and dimension using an injection molding machine. Finally the green compact is sintered to form the final product. The present binder composition eliminates the incompatibility problem which is often encountered when using multi-component binders; this allows the green compact to maintain excellent dimensional and physical integrities both before and during the sintering step and thus ensures the precise dimension of the final products.

17 Claims, 5 Drawing Sheets

HIGH PERFORMANCE BINDER/MOLDER COMPOUNDS FOR MAKING PRECISION METAL PART BY POWDER INJECTION MOLDING

FIELD OF THE INVENTION

The present invention relates to a binder composition for making precision metal parts from a metallic powder by powder injection molding process. More specifically, the present invention relates to a (i.e., binders or molding compounds) to be mixed with metallic particulates before forming a green compact via an injection molding process. The binder composition allows the green compact to maintain excellent physical and dimensional integrities during the subsequent debinding and sintering stage to thereby ensure the required precision of the final sintered products.

BACKGROUND OF THE INVENTION

Powder injection molding is an emerging technology for making metal parts. One of the main advantages of using the powder injection molding method is that it provides a quick and relatively simple way to fabricate small, high-precision three-dimensional parts with relatively complicated external features. Typically, the powder injection molding process involves the steps of first mixing a metal powder with a multi-component binder composition, then forming a green compact from the metal powder/binder mixture via an injection molding process. The green compact is then subject to debinding (by firing) and sintering steps until the sintered body has taken its permanent predetermined form. The use of multiple components in the binder composition allows the various components to be sacrificed at different stages to avoid deformation or collapse of the green compact during the debinding step, thus ensures the dimensional integrity of the final product.

The most commonly used binder composition used in the metal powder injection molding typically contains two or more polymeric components and an appropriate amount of oil or wax. Fatty acids are conventionally added to the binder composition as a surface active agent and/or plasticizer. The binder composition then blendes with metallic powder to form an injection/-molding composition. The polymeric components contained in the binder composition typically include non-crystalline polymers such as polystyrene, and crystalline polymers such as polypropylene. Because of the different properties among the various polymeric components in the binder composition, compatibility often becomes a problem. And the incompatibility between or among the polymeric components can result in inhomogeneity in the binder composition and adversely affect the dimensional integrity as well as the precise shape of the sintered parts, making the precision control the final dimension and shape of the final products difficult.

U.S. Pat. No. 4,158,688 discloses a sacrificial binder composition for molding particulate solids, including powder of lithium-modified beta-alumina, into sintered products. The binder composition disclosed in the '688 patent comprises a block copolymer and a plasticizer. The block copolymer is represented by the following formula: $X\text{-}[B(AB)_{\eta}A]_{\eta'}$, wherein "A" is a linear or branched polymer that is glassy or crystalline at room temperature, "B" is a polymer that behaves as an elastomer at processing temperature, "$\eta$" is 0 or a positive integer, "$\eta'$" is a positive integer greater than 2, and "X" is either "A" or "B". The plasticizer may be oil, wax, or oil and wax. The copolymer disclosed in the '688 patent does not address any compatibility problem when multiple polymeric binder components are used.

U.S. Pat. No. 4,283,360 discloses a process for producing molded ceramic metal by which a solvent-soluble resin and a solvent-insoluble resin, a ceramic or metallic powder and a plasticizer are blended and molded. The molded product is treated with an organic solvent to dissolve the solvent-soluble resin. Then, the treated product is fired to obtain a molded ceramic or metal product. Again, the potential incompatibility problem was not addressed between the solvent-soluble and solvent-insoluble resins, and the dimensional integrity of the sintered product can be adversely affected as a result of such incompatibility.

SUMMARY OF THE INVENTION

The primary object of the present invention is to provide an improved binder composition for use in the powder injection molding of metal parts. More specifically, the primary object of the present invention is to provide an improved binder composition to be mixed with metallic powder for fabricating high-precision metal parts using powder injection molding process to make a green compact followed by debinding and sintering. The binder composition of the present invention exhibits excellent compatibility, is uniformly distributed in the green compact in a very homogeneous manner, and thus allows the green compact to exhibit excellent physical and dimensional integrity both before and during the subsequent sintering stage to thereby ensure the required precision of the final products.

The binder composition of the present invention comprises a first polymer with a relatively low solubility parameter, a second polymer with a relatively high solubility parameter, and a block copolymer containing blocks of the constituting monomers of the first and second polymers, or of monomers of respectively similar structures, wherein the block copolymer serves as a solubilization aid which causes the first and the second polymers to be mutually miscible to thereby form a homogeneous liquid mixture exhibiting high flowability. The definition of solubility parameter can be found in many polymer textbooks such as *Polymer Chemistry*, 2nd. ed., by Raymond B. Seymour and Charles E. Carraher, Jr., Marcel Dekker, Inc. (1988). Preferably, the first polymer is polypropylene, the second polymer is polystyrene, and the copolymer is a copolymer of ethylene or propylene and styrene, or an isoprene/styrene block copolymer. Other first/second polymer combinations can also be used in preparing the binder composition of the present invention; examples of these first-/second polymer combinations include: polypropylene-/poly(methyl methacrylate), polyethylene/polystyrene, polyethylene/poly(methyl methacrylate), etc.

In a preferred embodiment of utilizing the binder composition of the present invention, polypropylene, polystyrene, and an ethylene-styrene block copolymer are blended to form a white milky mixture. The milky mixture is then uniformly dispersed in a plasticizer, such as oil or wax, or a mixture of oil and wax, to form an injection molding binder composition, which can be mixed with metal powder before subsequent injection molding. The block copolymer disclosed in the present invention exhibits thermoplastic characteristic at elevated temperatures. After it is cooled down, the binder composition posseses excellent adhesive characteristics. Therefore, it provides the required characteristics to enable the injection molded green compact prepared from the metal powder/binder mixture to retain the required dimensional integrity and strength during debinding and subsequent sintering steps.

The binder composition, which contains polypropylene (or other equivalent polymers), polystyrene (or other equivalent polymers), and block copolymers of ethylene or propylene and styrene (or block copolymers of other respectively equivalent monomers), exhibits a melt index (MI) ranging from 1~100 g/10 min at a test temperature of 200° C. under a load of 6.2 Kg. The uniformity and homogeniety of the binder composition can be examined by spreading a thin layer of the binder composition on a glass plate and visually inspecting the uniformity and homogeneity of the coating layer.

BRIEF DESCRIPTION OF THE DRAWING

The present invention will be described in detail with reference to the drawing showing the preferred embodiment of the present invention, wherein.

DETAILED DESCRIPTION OF THE PREFERRED EMBODIMENT

Figure 1:
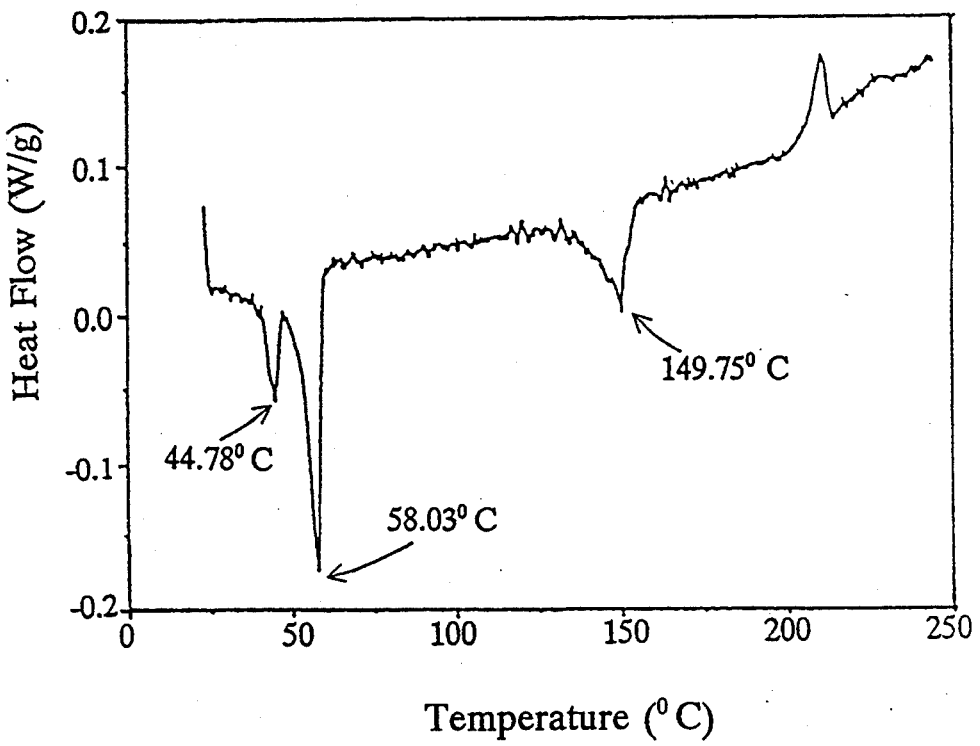
FIG. 1 is a plot of the DSC thermal analysis of the binder composition prepared in Example 3.
Figure 2A:
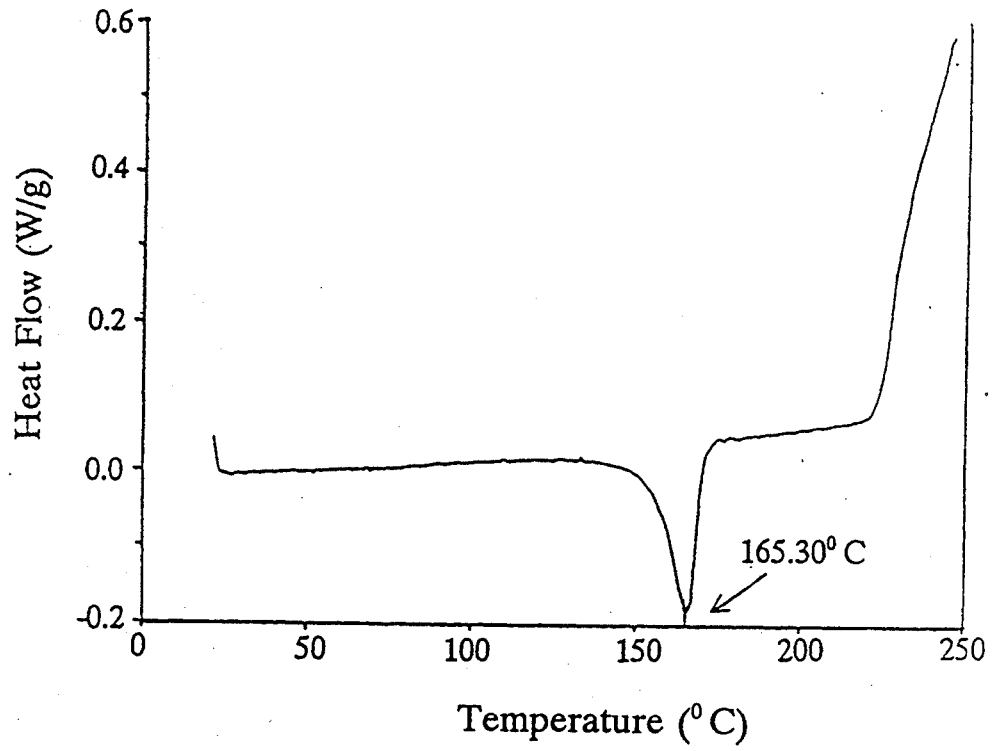
FIGS. 2A through 2D are plots of DSC thermal analyses of polypropylene, polystyrene, ethylene/styrene copolymer, and paraffin wax, respectively, which were used to prepare the binder composition in Example 3.
Figure 2B:
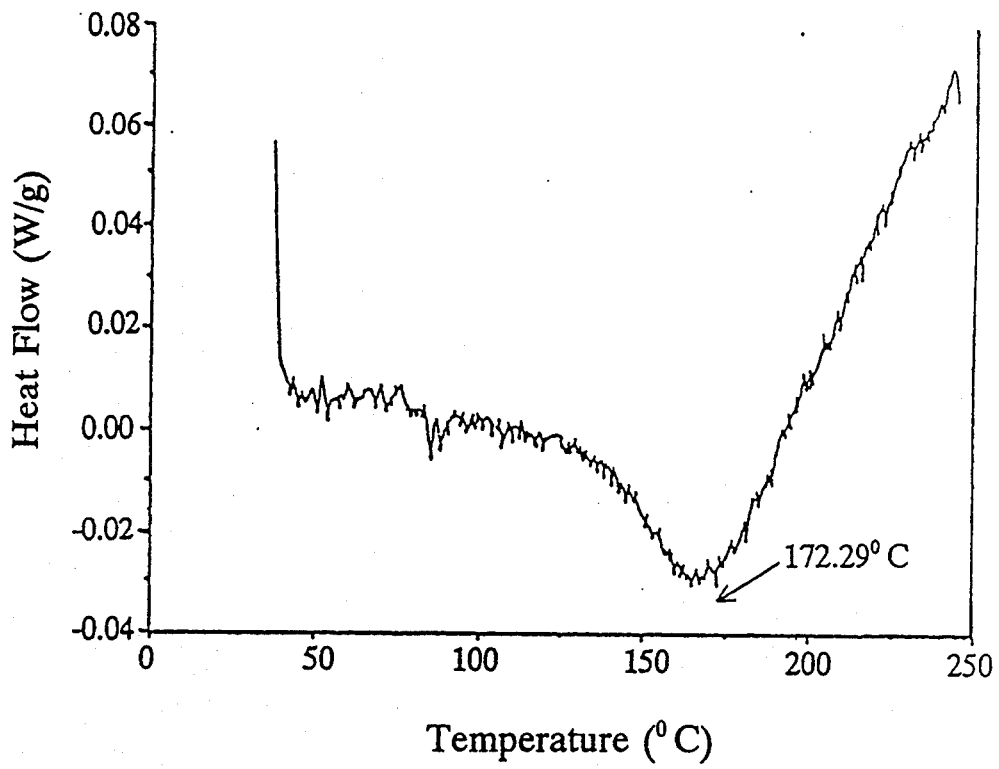
Figure 2C:
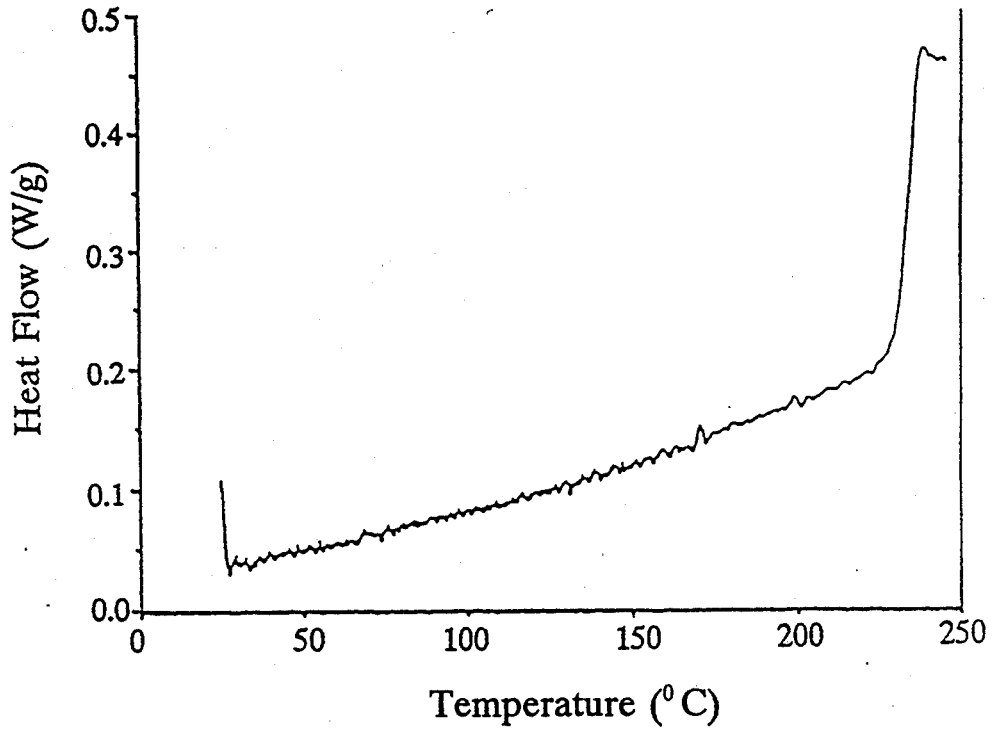
Figure 2D:
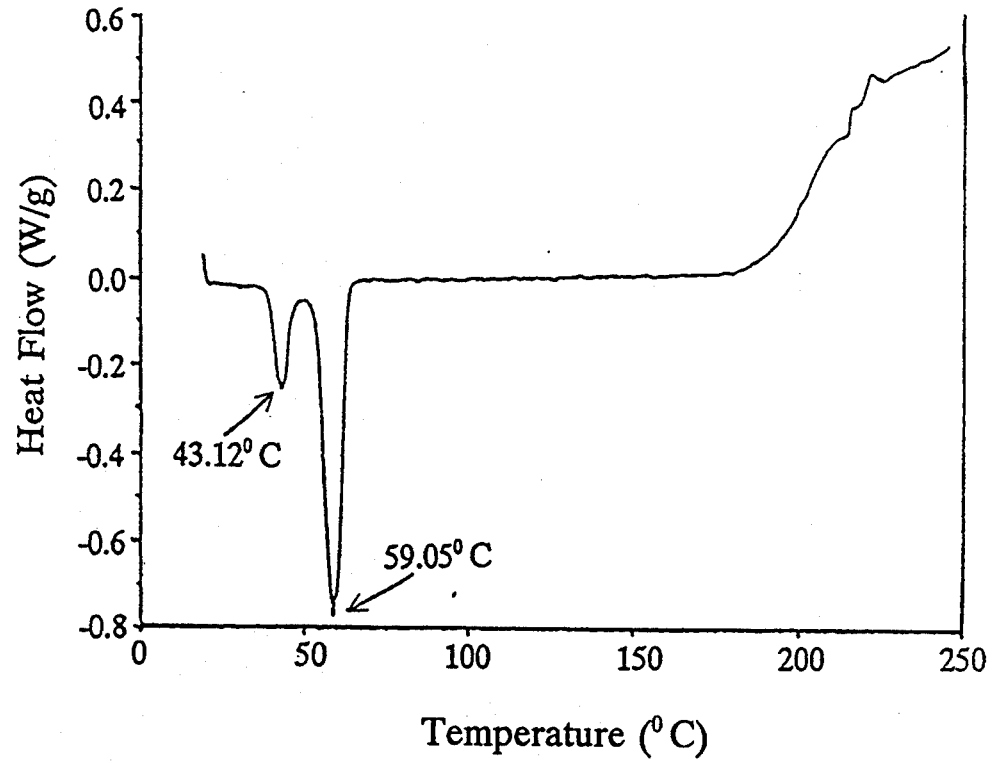

The present invention discloses a binder composition, which comprises (1) a first polymer having a relatively high crystallinity and low solubility parameter, (2) a second polymer having a relatively low crystallinity and high solubility parameter, and (3) a block copolymer containing blocks of the constituting monomers of the first and second polymers, or of monomers of respectively similar structures. In the binder composition disclosed in the present invention, the block copolymer serves as a solubilization aid causing the first and the second polymers to be mutually miscible to thereby form a homogeneous liquid mixture. As discussed below, the first polymer is preferably polypropylene, the second polymer is preferably polystyrene, and the copolymer is preferably a copolymer of ethylene or propylene and styrene. Other first/second polymer combinations that can also be used in preparing the binder composition of the present invention include: polypropylene/poly(methyl methacrylate), polyethylene/polystyrene, polyethylene/poly(methyl methacrylate), etc.

In preparing an injection molding composition, the first polymer (i.e., polypropylene or other equivalent polymer), the second polymer (i.e., polystyrene or other equivalent polymer) and an ethylene-styrene block copolymer are blended to form a white gellish mixture. The gellish mixture is then uniformly dispersed in a plasticizer, which can be an appropriate oil or wax, or a mixture thereof to form the final injection molding binder. The final injection binder so prepared is then mixed with metal powder to form the injection molding composition, which is subsequently subjected to an injection molding to form a green compact. The green compact is sintered to form the final metal parts of predetermined shape and dimension.

The present invention will now be described more specifically with reference to the following examples. It is to be noted that the following descriptions of example including preferred embodiment of this invention are presented herein for purpose of illustration and description; it is not intended to be exhaustive or to limit the invention to the precise form disclosed.

EXAMPLE 1

Polypropylene, polystyrene, and block copolymer of ethylene and styrene were mixed in accordance with various proportions as shown in Table 1 to form fifteen homogeneous blends (Blend 15 contained the copolymer only). These blends were respectively blended at 175° C. for 40 minutes. The units of the components shown in Table 1 are in grams. The melt indexes (MI) of polypropylene, polystyrene, and the ethylene/styrene block copolymer are: 35 g/10 min, 22 g/10 min, and 12 g/10 min, respectively, at a test condition of 180° C. and 6.2 Kg. Test results are summarized in Table 1. It was observed that without the ethylene/styrene block copolymer, the blends were inhomogeneous and opaque. The light transparency of the blend generally increased as the amount of the ethylene/styrene block copolymer increased.

TABLE 1

| Component/ | Blends | | | | | | | | | | | | | | |
|---|---|---|---|---|---|---|---|---|---|---|---|---|---|---|---|
| Tests | 1 | 2 | 3 | 4 | 5 | 6 | 7 | 8 | 9 | 10 | 11 | 12 | 13 | 14 | 15 |
| polypropylene | 30 | 29.5 | 29 | 28.5 | 28 | 27.5 | 25 | 22.5 | 20 | 17.5 | 15 | 12.5 | 10 | 5 | 0 |
| polystyrene | 30 | 29.5 | 29 | 28.5 | 28 | 27.5 | 25 | 22.5 | 20 | 17.5 | 15 | 12.5 | 10 | 5 | 0 |
| copolymer | 0 | 1 | 2 | 3 | 4 | 5 | 10 | 15 | 20 | 25 | 30 | 35 | 40 | 50 | 60 |
| MI | 51 | 58 | 48 | 48 | 46 | 4 | 28 | 24 | 21 | 17 | 14 | 12 | 8 | 6 | 12 |
| appearance | * | homoneneous phase ← Increasing milkness, increasing transparence → | | | | | | | | | | | | | ** |
| light-transparency | No | Yes | Yes | Yes | Yes | Yes | Yes | Yes | Yes | Yes | Yes | Yes | Yes | Yes | Yes |

*inhomogeneous, phase separation
**transparent

EXAMPLE 2

The blends 2~15 prepared in Example 1 were dispersed in a paraffin wax dispersant to form corresponding binder compositions 2~15.

EXAMPLE 3

Figure 3:
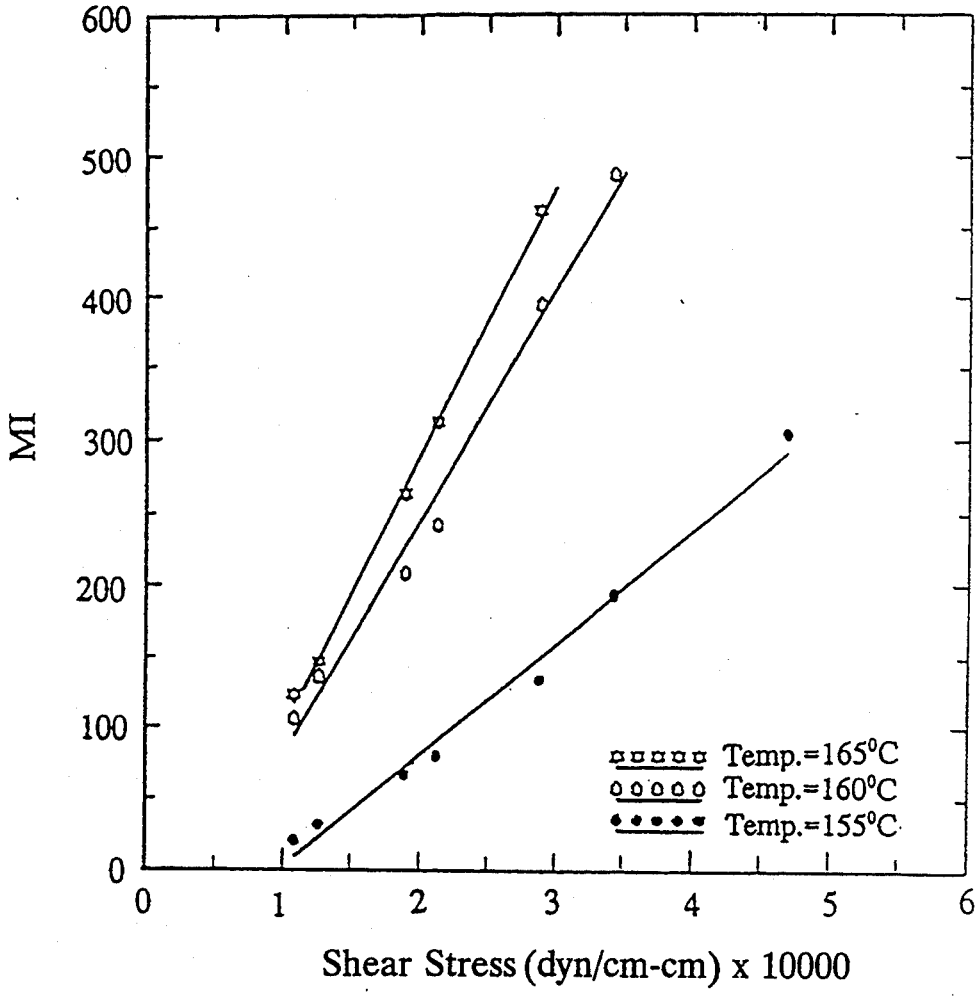
FIG. 3 shows the relationship between melt index and shear stress at various temperatures measured for the binder composition prepared in Example 3.

A binder composition containing polypropylene, polystyrene, paraffin wax and ethylene/styrene block copolymer in a weight ratio of 6/6/6/1 was prepared and tested. The melt index measured at 3.8 Kg/155° C. was 220 g/10 min. Other test results are summarized in Table 2. The DSC thermal analysis of the binder composition is shown in FIG. 1. And the DSC thermal analyses of the constituting components, i.e., polypropylene, polystyrene, ethylene/styrene block copolymer and paraffin wax, are shown in FIGS. 2(A) through 2(D), respectively. FIG. 3 shows the relationship between melt index and shear stress at various temperatures. Table 2 shows the relationship between the measured melt index and test conditions, including test temperature (in °C.) and test load (in Kg).

TABLE 2

| Temp. | Load (Kg) | | | | | | |
|---|---|---|---|---|---|---|---|
| (°C.) | 5.2 | 3.8 | 3.2 | 2.36 | 2.1 | 1.4 | 1.2 |
| 165 | * | * | 463 | 312 | 264 | 147 | 123 |
| 160 | * | 488 | 395 | 242 | 208 | 136 | 106 |
| 155 | 304 | 220 | 135 | 80 | 67 | 32 | 20 |

*too fast to be accurately measured.

EXAMPLE 4

A metal powder injection composition was prepared by blending carbonyl iron powder (CIP) with 10% by weight of the binder composition prepared from Example 3 at 190° C. for 50 minutes. The resultant injection composition exhibited high flowability. Its melt index was measured to be 140 g/10 min, at 6.2 Kg/160° C.

EXAMPLE 5

A binder composition containing polypropylene, poly(methyl methacrylate), paraffin wax and ethylene/styrene block copolymer in a weight ratio of 6/6/6/1 was prepared and tested. The melt index measured at 3.8 Kg/155° C. was 660 g/10 min.

EXAMPLE 6

A metal powder injection composition was prepared by blending carbonyl iron powder with 10% by weight of the binder composition prepared from Example 5 at 190° C. for 50 minutes. The resultant injection composition also exhibited high flowability. Its melt index was measured to be 178 g/10 min, at 6.2 Kg/160° C.

EXAMPLE 7

A binder composition containing polyethylene, polystyrene, paraffin wax and ethylene/styrene block copolymer in a weight ratio of 6/6/6/1 was prepared and tested. The melt index for polyethylene was measured to be 46 g/10 min at 0.325 Kg/125° C. The melt index measured for the binder composition at 3.8 Kg/155° C. was 175 g/10 min.

EXAMPLE 8

A metal powder injection composition was prepared by blending carbonyl iron powder with 10% by weight of the binder composition prepared from Example 7 at 190° C. for 50 minutes. The resultant injection composition also exhibited high flowability. Its melt index was measured to be 190 g/10 min, at 6.2 Kg/160° C.

EXAMPLE 9

A binder composition containing polyethylene, poly(methyl methacrylate), paraffin wax and ethylene/styrene block copolymer in a weight ratio of 6/6/6/1 was prepared and tested. The melt index for polyethylene was measured to be 46 g/10 min at 0.325 Kg/125° C. The melt index measured for the binder composition at 3.8 Kg/100° C. was 112 g/10 min.

EXAMPLE 10

A metal powder injection composition was prepared by blending carbonyl iron powder with 10% by weight of the binder composition prepared from Example 9 at 190° C. for 50 minutes. The resultant injection composition also exhibited high flowability. Its melt index was measured to be 270 g/10 min, at 6.2 Kg/160° C.

EXAMPLE 11

Several binder compositions were prepared using a procedure similar to that described in Example 3, except that the paraffin wax dispersant used in Example 3 was replaced with one of those dispersants listed in Table 3. Corresponding metal powder injection compositions were then prepared by blending carbonyl iron powder with 10% by weight of the binder compositions so prepared, at 190° C. for 50 minutes. The melt indexes measured from these metal powder injection compositions are also summarized in Table 3.

TABLE 3

| Temp. | Dispersant | | | | | | | | | |
|---|---|---|---|---|---|---|---|---|---|---|
| (°C.) | 1 | 2 | 3 | 4 | 5 | 6 | 7 | 8 | 9 | 10 |
| 160° C. | 160 | * | 93 | 26 | * | | 23 | 156 | 52 | 90 |
| 170° C. | | * | | | 201 | | | | | |
| 180° C. | | 12 | | | | * | | | | |
| | 11 | 12 | 13 | 14 | 15 | 16 | 17 | 18 | 19 | 20 |
| 160° C. | 119 | 124 | 145 | 257 | 159 | * | 140 | 201 | 86 | 186 |
| 170° C. | | | | | | * | | | | |
| 180° C. | | | | | | 41 | | | | |

Dispersant: 1: soybean oil; 2: hydrogenated soybean oil; 3: olive oil; 4: peanut oil; 5: sesame oil; 6: linseed oil; 7: corn oil; 8: pork oil; 9: butter; 10: lubricant oil (I); 11: lubricant oil (II); 12: vacuum pump oil (I); 13: vacuum pump oil (II); 14: caoutchouc lubricant; 15: R68 cycling oil; 16: sunflower oil; 17: paraffin wax; 18: fossil resin; 19: Brazil wax (Carnauba wax); 20: microcrystalline wax.
*immobile

EXAMPLE 12

Figure 4:
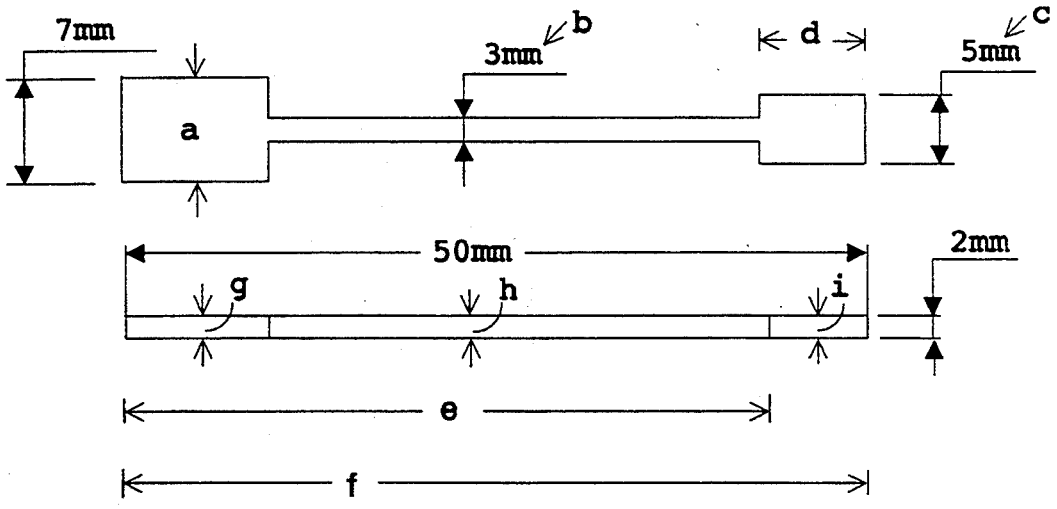
FIG. 4 is a schematic drawing showing a test specimen of a green compact suspended on top of two supports for measuring its tendency to warp.

A metal specimen green compact as shown in FIG. 4 was fabricated from the metal powder injection composition prepared in Example 4 using an injection molding process. The transverse rupture strength of the test specimen was measured to be 4.0 Kg/mm$^2$.

EXAMPLE 13

Figure 5:
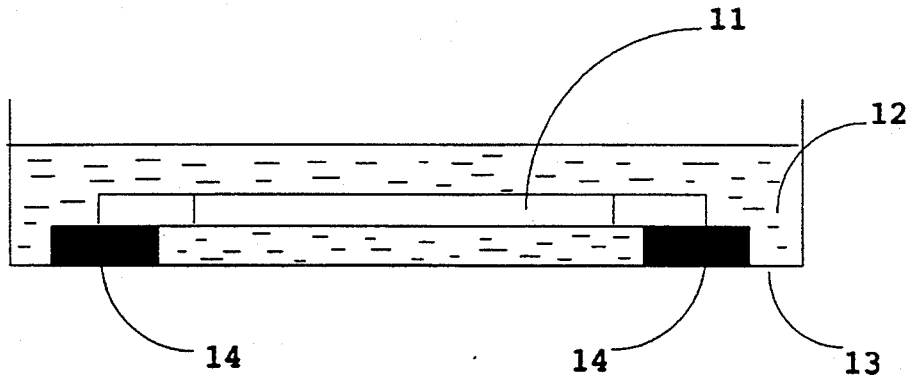
FIG. 5 shows the various portions of a sintered metal powder product as described in Table 4 for reporting the dimensional stability of the sintered product prepared using the binder composition of the present invention.

Referring now to FIG. 5. The metal test specimen 11 prepared in Example 12 was suspended on top of two supports 14 and immersed in n-heptane 12 contained in a container 13, for six hours. No warping was obsered from the test metal specimen.

EXAMPLE 14

A metal powder injection composition was prepared by blending stainless steel 304L powder, having an average particle diameter of 9.8 μm, with 10% by weight of the binder composition prepared from Example 3, at 180° C. for 50 minutes. The resultant injection composition exhibited high flowability. Its melt index was measured to be 300 g/10 min, at 6.2 Kg/170° C. A metal specimen similar to Example 12 was fabricated from this metal powder injection composition using an injection molding process. The transverse rupture strength of the test specimen was measured to be 3.0 $Kg/mm^2$. The metal test specimen was suspended on top of two supports and immersed in n-heptane, as in Example 13, for six hours. No warping was observed from the test metal specimen.

EXAMPLE 15

A metal powder injection composition was prepared by blending stainless steel 316L powder, having an average particle diameter of 9.8 μm, with 10% by weight of the binder composition prepared from Example 3, at 180° C. for 50 minutes. The resultant injection composition exhibited high flowability. Its melt index was measured to be 265 g/10 min, at 6.2 Kg/170° C. A metal specimen similar to Example 12 was fabricated from this metal powder injection composition using an injection molding process. The transverse rupture strength of the test specimen was measured to be 3.0 $Kg/mm^2$. The metal test specimen was suspended on top of two supports and immersed in n-heptane, as in Example 13, for six hours. No warping was obsered from the test metal specimen.

EXAMPLE 16

A metal powder injection composition was prepared by blending carbonyl iron powder, having an average particle diameter of 5 μm, and carbonyl nickel powder, having an average particle diameter of 4 μm, in a weight ratio of carbonyl iron powder/carbonyl nickel powder=98/2, with 9% by weight of the binder composition prepared from Example 3, at 180° C. for 50 minutes. The resultant injection composition exhibited high flowability. Its melt index was measured to be 412 g/10 min, at 6.2 Kg/170° C. A metal specimen similar to Example 12 was fabricated from this metal powder injection composition using an injection molding process. The transverse rupture strength of the test specimen was measured to be 4.1 $Kg/mm^2$. The metal test specimen was suspended on top of two supports and immersed in n-heptane, as in Example 13, for six hours. No warping was observed from the test metal specimen.

EXAMPLE 17

A metal powder injection composition was prepared in a procedure similar to that described in Example 16, except that the weight ratio of carbonyl iron powder/carbonyl nickel powder equals 92/8. The resultant injection composition exhibited high flowability. Its melt index was measured to be 423 g/10 min, at 6.2 Kg/170° C.

EXAMPLE 18

A binder composition containing polypropylene, polystyrene, paraffin wax and isoprene/styrene block copolymer in a weight ratio of 6/6/6/1 was prepared and tested. The melt index measured at 3.8 Kg/155° C. was 281 g/10 min.

EXAMPLE 19

A metal powder injection composition was prepared by blending carbonyl iron powder with 10% by weight of the binder composition prepared from Example 18 at 190° C. for 50 minutes. The resultant injection composition exhibited high flowability. Its melt index was measured to be 176 g/10 min, at 6.2 Kg/160° C.

EXAMPLE 20

A metal powder injection composition was prepared by blending stainless steel 304L powder, having an average particle diameter of 9.8 μm, with 10% by weight of the binder composition prepared from Example 18, at 180° C. for 50 minutes. The resultant injection composition exhibited high flowability. Its melt index was measured to be 285 g/10 min, at 6.2 Kg/170° C.

EXAMPLE 21

The green compacts prepared in the above examples using the metal powder injection molding process were removed from the mold by a robotic arm. No damage or distortion was observed in any of the green compact test specimens.

EXAMPLE 22

The metal injection composition prepared in Example 17 was subject to an injection molding maching to form metal objects as shown in FIG. 6. The metal objects were debinded and sintered at 1250° C. for 75 minutes to form sintered objects. The dimensions of the sintered objects were measured at nine locations as shown in FIG. 6. The results are summarized in Table 4. It is clear from Table 4 that excellent dimensional stability can be obtained by using the binder composition disclosed in the present invention. With the binder composition disclosed in the present invention, the weight of the green compacts can be maintained within±0.1%, and the dimension of the final sintered can be maintained withing±0.3% of the designed value. Thus the present invention discloses an excellent composition for use as a binder in the metal powder injection molding of precision metal parts.

TABLE 4

| Test Specimen | Measured Dimension (mm) | | | | | | | | |
|---|---|---|---|---|---|---|---|---|---|
| | 1 | 2 | 3 | 4 | 5 | 6 | 7 | 8 | 9 |
| A | 5.77 | 2.47 | 4.11 | 8.22 | 32.9 | 41.1 | 1.64 | 1.64 | 1.63 |
| B | 5.76 | 2.47 | 4.11 | 8.19 | 32.9 | 41.2 | 1.64 | 1.64 | 1.63 |
| C | 5.76 | 2.47 | 4.11 | 8.19 | 32.9 | 41.2 | 1.63 | 1.64 | 1.63 |
| D | 5.79 | 2.47 | 4.11 | 8.18 | 32.9 | 41.1 | 1.64 | 1.63 | 1.63 |
| E | 5.77 | 2.47 | 4.11 | 8.20 | 32.9 | 41.1 | 1.63 | 1.64 | 1.63 |
| F | 5.77 | 2.47 | 4.11 | 8.17 | 32.9 | 41.1 | 1.64 | 1.65 | 1.63 |
| Average: | 5.77 | 2.47 | 4.11 | 8.19 | 32.9 | 41.1 | 1.63 | 1.64 | 1.63 |

The foregoing description of the preferred embodiments of this invention has been presented for purposes of illustration and description. Obvious modifications or variations are possible in light of the above teaching. The embodiments were chosen and described to provide the best illustration of the principles of this invention and its practical application to thereby enable those skilled in the art to utilize the invention in various embodiments and with various modifications as are suited to the particular use contemplated. All such modifications and variations are within the scope of the present invention as determined by the appended claims when interpreted in accordance with the breadth to which they are fairly, legally, and equitably entitled.

What is claimed is:

1. A binder composition for use in making metal parts via a metal powder injection molding process comprising:

(a) a first polymer, from about 8 wt % to about 49 wt % of said binder composition, said first polymer containing a plurality of first constituting monomeric units;

(b) a second polymer, from about 8 wt % to about 49 wt % of said binder composition, said second polymer containing a plurality of second constituting monomeric units; and (c) a block copolymer, from about 2 wt % to about 84 wt % of said binder composition, said block copolymer containing blocks of said first and second constituting monomeric units.

2. The binder composition according to claim 1 wherein said first polymer is polyethylene.

3. The binder composition according to claim 1 wherein said first polymer is polypropylene.

4. The binder composition according to claim 1 wherein said second polymer is polystyrene.

5. The binder composition according to claim 1 wherein said second polymer is poly(methyl methacrylate).

6. The binder composition according to claim 1 wherein said block copolymer is an ethylene/styrene block copolymer.

7. The binder composition according to claim 1 wherein said block copolymer is a propylene/styrene block copolymer.

8. The binder composition according to claim 1 wherein said block copolymer is an isoprene/styrene block copolymer.

9. A metal powder injection composition for making metal parts via a metal powder injection molding process comprising:

(a) a first polymer with a relatively low solubility parameter, said first polymer containing a plurality of first constituting monomeric units;

(b) a second polymer with a relatively high solubility parameter, said second polymer containing a plurality of second constituting monomeric units;

(c) a block copolymer containing blocks of said first and second, or other structurally similar, constituting monomeric units;

(d) a dispersant; and (e) a metal powder.

10. The metal powder injection composition according to claim 9 wherein said first polymer is polyethylene or polypropylene.

11. The metal powder injection composition according to claim 9 wherein said second polymer is polystyrene or poly(methyl methacrylate).

12. The metal powder injection composition according to claim 9 wherein said block copolymer is an ethylene/styrene block copolymer, a propylene/styrene block copolymer, or an isoprene/styrene block copolymer.

13. The metal powder injection composition according to claim 9 wherein said dispersant containing an oil or wax, or a mixture of oil and wax.

14. The metal powder injection composition according to claim 9 wherein said metal powder containing carbonyl iron powder.

15. The metal powder injection composition according to claim 9 wherein said metal powder containing stainless steel powder.

16. The metal powder injection composition according to claim 9 wherein said metal powder containing a mixture of carbonyl iron powder and carbonyl nickel powder.

17. The binder composition according to claim 1 wherein said first polymer having a first solubility parameter, said second polymer having a second solubility parameter, and said first solubility parameter being greater than said second solubility parameter.

* * * * *